United States Patent [19]

Kissinger

[11] 4,154,295

[45] May 15, 1979

[54] HEAT EXCHANGER TUBE SUPPORT ASSEMBLY

[75] Inventor: John A. Kissinger, San Diego, Calif.

[73] Assignee: General Atomic Company, San Diego, Calif.

[21] Appl. No.: 765,046

[22] Filed: Feb. 2, 1977

[51] Int. Cl.[2] ..... F28D 7/00

[52] U.S. Cl. ..... 165/162; 165/172; 165/178

[58] Field of Search ..... 165/162, 172, 178

[56] References Cited

U.S. PATENT DOCUMENTS

| | | | |
|---|---|---|---|
| 3,164,529 | 1/1965 | Waine et al. | 165/162 X |
| 3,239,426 | 3/1966 | Waine et al. | 165/162 X |
| 3,595,309 | 7/1971 | Hawkins | 165/172 X |
| 3,782,455 | 1/1974 | Wolowodiuk et al. | 165/162 |
| 3,989,105 | 11/1976 | Trepaud | 165/162 X |
| 4,013,024 | 3/1977 | Kochey, Jr. et al. | 165/162 X |
| 4,058,161 | 11/1977 | Trepaud | 165/162 X |

*Primary Examiner*—Ira S. Lazarus

*Attorney, Agent, or Firm*—Fitch, Even & Tabin

[57] ABSTRACT

A support assembly in a heat exchanger for securing tubes of a tube bundle in parallel, spaced-apart relation includes a plurality of concentrically arranged tube support rings for respectively securing circumferential groups of tubes in the tube bundle, each tube support ring being formed with inner and outer cylindrical support elements rigidly interconnected by a number of circumferentially spaced apart radial bars.

9 Claims, 7 Drawing Figures

FIGURE 1.
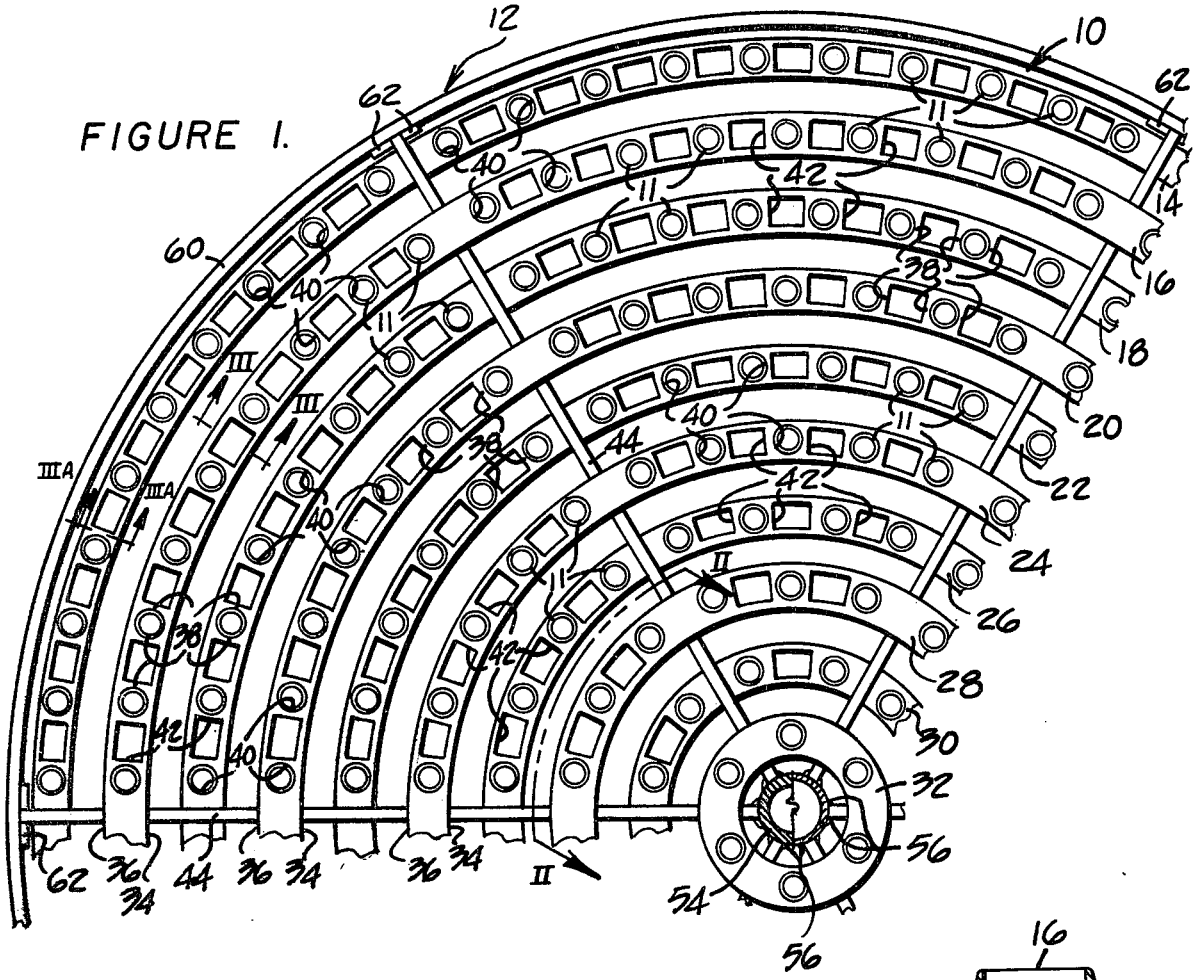
FIGURE 2.
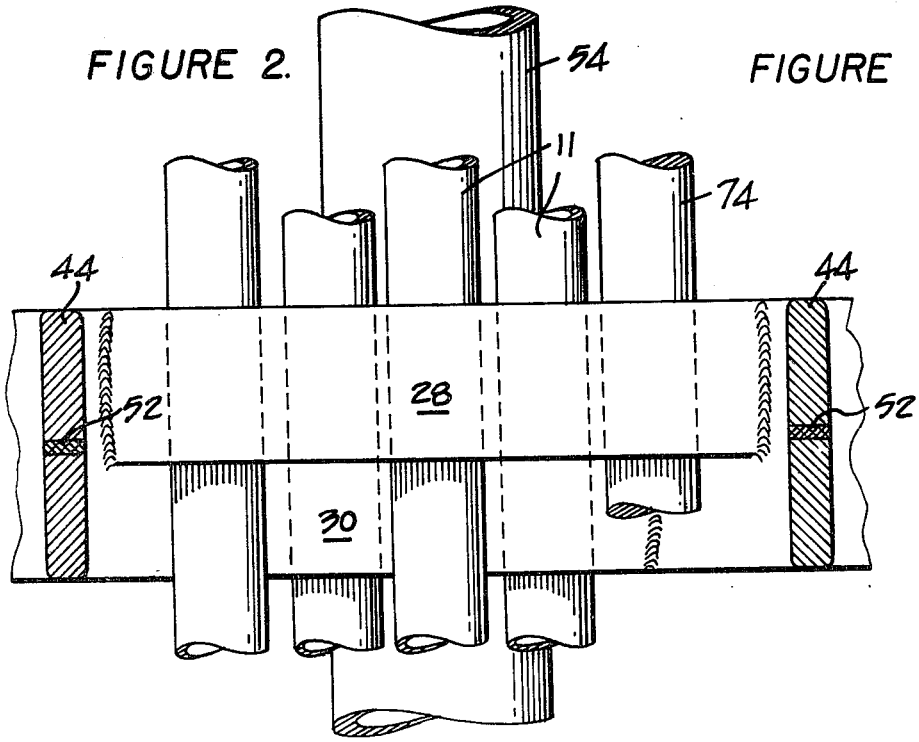
FIGURE 3.
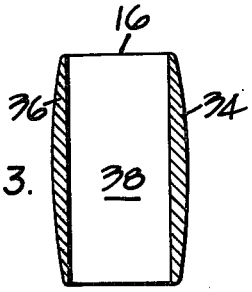
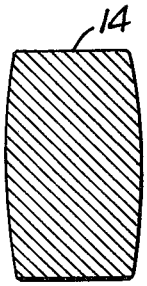
FIGURE 3A

HEAT EXCHANGER TUBE SUPPORT ASSEMBLY

BACKGROUND OF THE INVENTION

The present invention relates to heat exchanger tube bundles and more particularly to a support system for securing the tubes of a tube bundle in spaced-apart relation.

Heat exchangers of the type contemplated by the present invention commonly include tube bundles with relatively large numbers of parallel tubes. Within such heat exchangers, a first heat exchanger fluid may be circulated internally through the tubes of the tube bundle while a second heat exchanger fluid is circulated through the tube bundle exteriorly of the tubes in order to accomplish heat exchange between the two fluids. It is necessary to secure the large numbers of tubes in the tube bundle in place in order to protect the tubes from vibration, earthquakes and the like as well as to support their own dead weight. At the same time, it is necessary to maintain the parallel tubes in spaced-apart relation in order to permit circulation of the heat exchanger fluid around the tubes. Many support systems have been employed for this purpose in the prior art. However, the systems have been relatively complex in order to provide proper support for the tubes. Also, many of these prior art tube support systems include structures that tend to obstruct or interfere with the flow of the heat exchanger fluid around the tubes in the tube bundle.

Accordingly, there has been found to remain a need for an improved support system for heat exchanger tube bundles capable of providing adequate support for securing and maintaining the tubes in spaced-apart relation while presenting a minimum profile in order to facilitate the circulation of a heat exchanger fluid about the tubes in the tube bundle.

SUMMARY OF THE INVENTION

Accordingly, it is an object of the present invention to provide an improved support assembly for heat exchanger tube bundles.

It is a further object of the invention to provide such a support assembly including a plurality of tube support rings or members which are arranged in concentric or spaced-apart relation in order to provide support for a large number of tubes in the tube bundle, each tube support member having a minimum profile to permit relatively unobstructed passage of a heat exchanger fluid about the tubes in the bundle. Accordingly, each tube support member includes inner and outer support elements rigidly interconnected by means of circumferentially spaced-apart bars which are approximately equal in length to the diameter of the tubes.

It is a further object of the invention to provide a plurality of tube support rings or members wherein the bars are integrally interconnected radially between inner and outer cylindrical support elements. Preferably, the radial bars and the inner and outer cylindrical support elements are machined from a single original element and include openings for the tubes which are configured to closely conform with the supported tubes.

It is a still further object of the invention to provide a plurality of said tube support rings or members of varying sizes which are adapted for concentric arrangement in a heat exchanger tube bundle.

It is a further object of the invention to provide a heat exchanger tube bundle including one or more support assemblies each having a plurality of said tube support members.

Additional objects and advantages of the invention are made apparent in the following description having reference to the accompanying drawings.

BRIEF DESCRIPTION OF THE DRAWINGS

FIG. 1 is a fragmentary, sectioned view of a heat exchanger tube bundle taken along the axis of the tube bundle to illustrate the support assembly of the present invention.

FIG. 2 is a view taken along section line II—II of FIG. 1.

FIG. 3 is a view taken along section line III—III of FIG. 1.

FIG. 3A is a view taken along section line IIIA—IIIA of FIG. 1.

DESCRIPTION OF THE PREFERRED EMBODIMENTS

Figure 5:
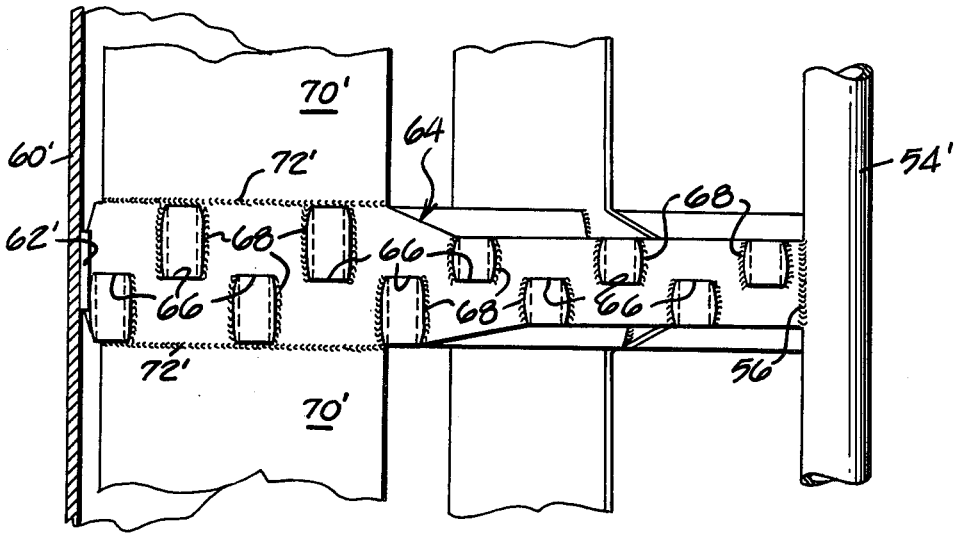
FIG. 5 is a view similar to FIG. 4 while illustrating yet another embodiment of the invention.

The present invention relates to a heat exchanger including a tube bundle of the type generally indicated at 10 in FIGS. 1 and 2. The tube bundle 10 includes a multiplicity of tubes 11 which are arranged in parallel, spaced-apart relation in order to permit circulation of a first heat exchanger fluid through the tubes with a second heat exchanger fluid being circulated exteriorly about the tubes to permit proper heat exchange between the two fluids.

A support assembly 12 is provided for supporting and securing the tubes 11 in their parallel, spaced-apart relation. Preferably, the tube bundle 10 is of a type including a large number of elongated straight tubes 11. However, it will be apparent from the following description that the support assembly of the present invention may also be employed for different configurations of tube bundles including tubes which are generally parallel at least at the point of support.

The support assembly 12 includes a plurality of tube support members indicated respectively at 14, 16, 18, 20, 22, 24, 26, 28, 30 and 32. The tube support members 14–32 are preferably cylindrical rings which have different overall diameters so that they may be arranged in concentric and generally uniform spaced-apart relation at an axial location along the length of the tube bundle 10.

The tube support rings 14–32 encompass 360° of the tube bundle and are of substantially similar construction except for their varying diameters. The construction of the tube support ring 16 is illustrated by the sectioned view of FIG. 3 which is also representative of the construction for the remaining tube support rings.

Each of the tube support rings includes inner and outer cylindrical support elements 34 and 36 which are structurally interconnected by means of radially extending bars 38. The radial bars 38 are circumferentially spaced apart from each other to alternately form tube openings 40 for receiving the tubes 11 and flow passages 42 for minimizing the flow blockage of the tube support rings and permitting relatively unobstructed passage of a heat exchanger fluid exteriorly about the tubes 11. The length of the radial bars 38 is approximately equal to the diameter of the tubes 11 in order to provide better support for the tubes while further minimizing the flow obstructing profile of the tube support rings.

The structural configuration of the inner and outer cylindrical elements 34, 36 and the radial bars 38 may best be seen in FIG. 3. Referring momentarily to FIG. 1, it may be seen that FIG. 3 is a sectioned view through one of the flow passages 42. A substantially similar cross-sectional view would result if section line III—III intersected the center of one of the tube openings 40. Preferably, the tube openings 40 conform to the cylindrical shape of the tubes 11 in order to better secure and maintain the tubes 11 in place within the tube bundle 10 while the flow passages 42 are generally rectangular to further minimize flow blockage.

It is also an important feature of the present invention to stagger adjacent pairs of the tube support rings 14–32 relative to the axis of the tube bundle 10 in order to even further minimize their composite profile at any axial location along the tube bundle and thereby further decrease the pressure drop experienced by a heat exchanger fluid flowing about the tubes 11. It is particularly contemplated that exterior fluid flow axially along the tube bundle with minimum deflection and minimum variation of flow rate or pressure. This is accomplished by the staggered arrangement of the tube support rings. The support rings could of course be arranged in a single axial plane if a design advantage could thus be achieved. However, such an arrangement would tend to cause expansion or contraction of the exterior gas flow which would cause an undesirable pressure drop at the common axial location of the support rings. It would also be possible to arrange a complete set of support rings at more than two axial levels or locations in order to even further minimize their effect on the exterior flow of fluid. The staggered arrangement of the tube support rings is described in greater detail below.

Various structural support means for the tube support rings 14–32 are contemplated within the present invention. Referring particularly to FIG. 1, the tube support rings 14–32 are supported in place relative to the tube bundle 10 by support beams 44 which are radially arranged in spaced-apart relation about the circumference of the tube bundle. Within the embodiment described herein, each of the beams 44 has a length approximately equal to the radius of the tube bundle 10. However, it will be obvious that the beams 44 could extend across the entire diameter of the tube bundle with structural support being provided either along the axis or at the periphery of the tube bundle.

Figure 4:
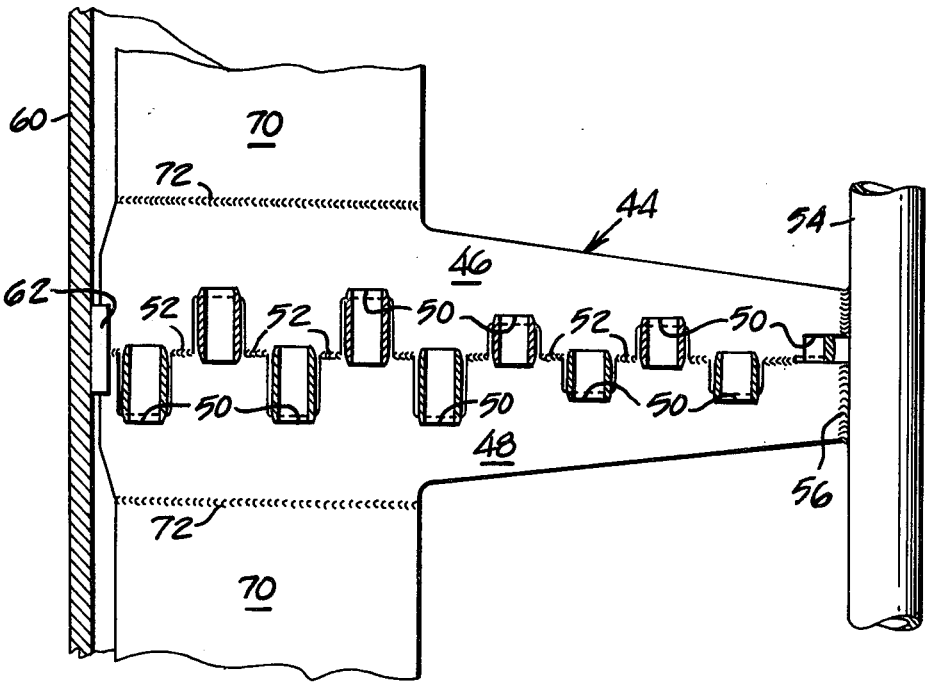
FIG. 4 is a fragmentary side view of a single radial support beam, taken along the length thereof, to illustrate another embodiment of the present invention.

Two additional embodiments of the radial beams are illustrated in FIGS. 4 and 5. The tube support rings are clamped in place between two radial beam elements 46 and 48 which form the radial beam 44′ in the embodiment of FIG. 4. Slots 50 for receiving the respective tube support rings 14–32 are alternately formed along the interfacing edges of the respective radial beam elements 46 and 48. With the tube support rings being arranged in place, the interfacing edges of the radial beam elements 46 and 48 are secured together by weld joints indicated at 52. The radially inner end of the beam 44′ is secured to an axial member 54′ (also indicated at 54 in FIG. 1) by a weld joint generally indicated at 56′ (also at 56 in FIG. 1). The axial member 54 is hollow in order to contain instrumentation, for example, and is preferably shaped with a smooth contour to minimize interference with fluid flow.

Support is provided for the radial beams at their outer ends to prevent both axial movement and/or relative rotation of the tube support rings 14–32 about the axis of the tube bundle. For this purpose, the tube bundle 10 (also see FIG. 2) is surrounded by a cylindrical casing 60′ (62 in FIG. 1) which includes brackets such as that indicated at 62′ (62 in FIG. 1) for restraining the respective radial beam 44′ against axial and circumferential movement. The beam 44′ could also be attached directly to the casing 60′, for example, by a weld joint (not shown) which would eliminate need for the bracket 62′.

Another embodiment of the radial beam is illustrated at 64 in FIG. 5. The beam 64 includes slots 66 which are spaced apart along the length of each beam to respectively receive the tube support rings 14–32. The staggered configuration for the tube support rings 14–32, as referred to above, is provided by alternating the slots 66 on opposite sides of the beam 64. The tube support rings 14–32 are preferably secured in place within the respective slots 66 by means of weld joints indicated at 68.

Elements corresponding to the axial member 54, weld joints 56, casing 60 and bracket 62 in FIG. 4 are also illustrated in FIG. 5 and serve a similar function.

Additional means may also be provided for replacing the support accomplished either by the brackets 62′ of FIG. 4 or FIG. 5. For example, the other end of each radial beam 44′ (or beam 64 of FIG. 5) could be secured both against circumferential and axial movement by interconnecting it with a tie plate such as those indicated at 70 and 70′ in FIGS. 4 and 5 respectively. Each of the tie plates 70, 70′, as illustrated in FIGS. 4 and 5, is secured to the outer end of one of the radial beams 44′ or 64, for example by weld joints indicated at 72 or 72′, in order to secure the beams against both circumferential and axial movement.

An additional means for mounting the tube support rings 14–32 may best be seen by reference to FIG. 2. In place of or in conjunction with the brackets 62 or tie plates 70, the tube support rings 14–32 could be restrained against both axial and circumferential movement by tie rods of generally the same shape as the tubes 11 and extending along the length of the tube bundle 10 to provide structural support. Such a tie rod is indicated at 74 and extends through one of the tube openings 40 in the tube support ring 30. The tube support ring may be secured to the tie rods for example by welding or a suitable bracket (not shown). The tie rods could be spaced throughout the cross-section of the tube bundle to provide support for rings 14–32. Such a configuration might best be adapted to provide support for irregularly shaped tube bundles which are other than circular in cross-section. However, use of such tie rods would require the removal of a corresponding number of tubes 11 from the tube bundle 10.

Figure 6:
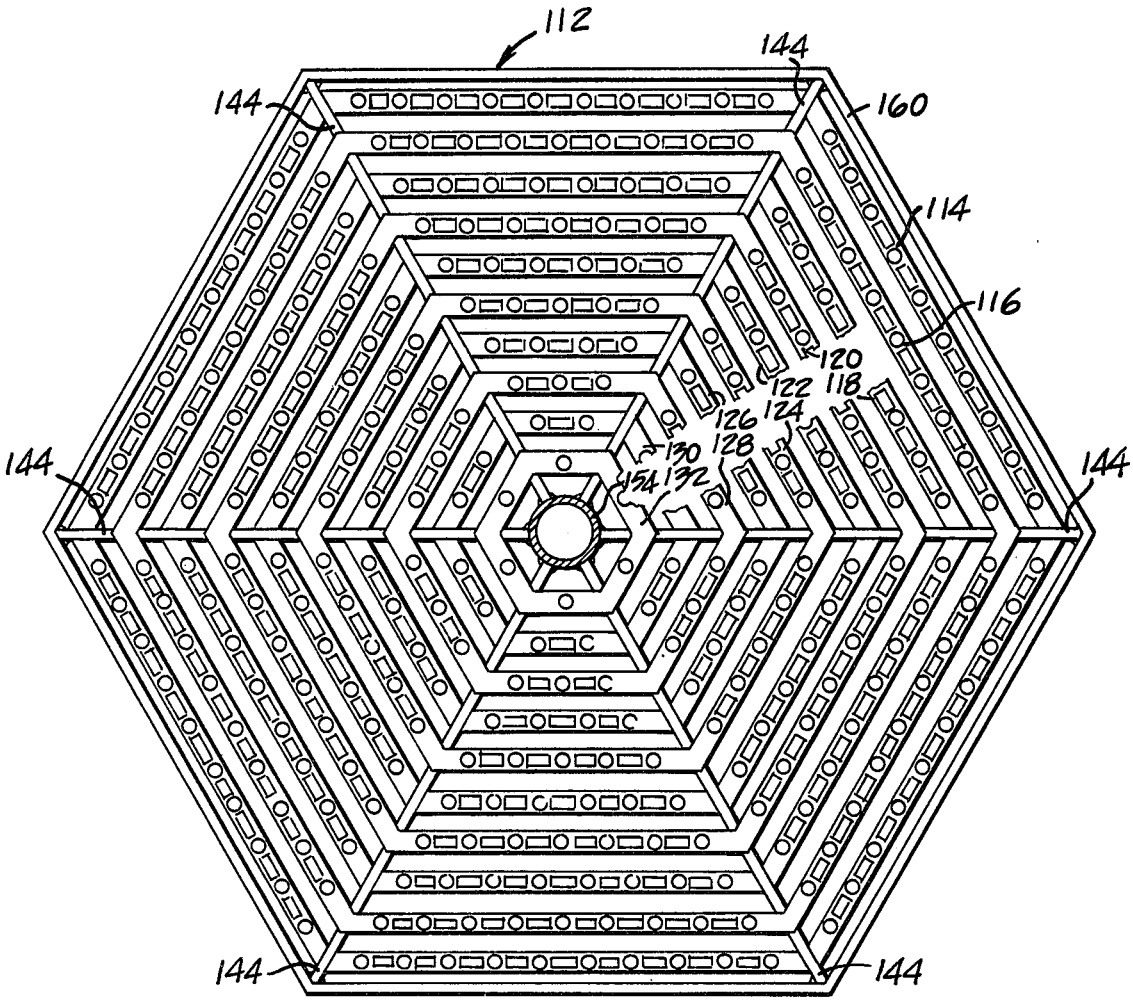
FIG. 6 is also a view taken along the axis of a heat exchanger tube bundle to illustrate yet another embodiment of the support assembly of the present invention.

Another embodiment of a support assembly is indicated at 112 in FIG. 6 for securing a tube bundle such as that illustrated in FIG. 2. The assembly of FIG. 6 is similar in many respects to the assembly 12 of FIG. 1. Therefore, components of the assembly 112 which correspond to components of the assembly 12 are identified by similar numerical labels preceded by the additional digit "1." For example, the cylindrical tube support rings 14–32 of FIG. 1 are replaced by hexagonally shaped tube support members 114–132. Except for their hexagonal configuration, the members 114–132 are of similar construction as the rings 14–32 and have the same cross-sectional configuration as is illustrated in FIGS. 3 and 3A. The radial beams 144 and the axial member 154 are similar to the same elements indicated at 44' and 54 in FIG. 1. The casing 160 is of a hexagonal configuration similar to the tube support members 114–132 but could also be cylindrically shaped like the casing 60 in FIG. 1. The outer ends of the radial bars 144 could be supported on the casing 160 by brackets similar to those illustrated at 62 in FIG. 1 but are preferably welded directly to the casing 160 in FIG. 6.

Additional variations and modifications are possible within the scope of the present invention in addition to those described above. Accordingly, the scope of the present invention is defined only by the following appended claims.

What is claimed is:

1. A support assembly for securing tubes in a heat exchanger tube bundle in parallel spaced apart relation, comprising a plurality of tube support members concentrically arranged to respectively support and secure individual tubes in the tube bundle, each tube support member including inner and outer support elements rigidly interconnected by means of bars, the lengths of the bars being approximately equal to the diameter of the tubes supported by the respective support member, the bars being spaced apart from each other to form tube openings for receiving and locating respective tubes of the tube bundle and flow passages for permitting relatively unobstructed passage of a heat exchanger fluid exteriorly about the tubes, structural support means supporting and limiting movement of said plurality of tube support members, said structural support means including a plurality of radially arranged beams, each radial beam including means spaced along its length for securing the respective tube support members with adjacent tube support members being axially offset relative to each other in order to minimize resistance to flow of a heat exchanger fluid through the tube bundle, and at least one support element extending along the length of the tube bundle for mounting the radial beams.

2. The support assembly of claim 1 wherein the bars for each tube support member are integrally interconnected between said inner and outer elements.

3. The support assembly of claim 2 wherein the bars and the inner and outer support elements for each tube support member are formed by machining from a single original piece.

4. The support assembly of claim 1 wherein the tube openings are configured to closely conform with the respectively supported tubes.

5. The support assembly of claim 1 wherein adjacent tube support members in the support assembly are axially staggered in order to minimize resistance to flow of a heat exchanger fluid through the tube bundle.

6. The support assembly of claim 1 wherein the means spaced along the length of each radial beam comprises a plurality of slots for respectively receiving the tube support members.

7. The support assembly of claim 6 wherein adjacent slots in said radial beam are arranged in axially opposite facing directions relative to the tube bundle to provide a staggered configuration for said tube support members.

8. The support assembly of claim 6 wherein each said radial beam is formed from two components secured together at an interface, adjacent slots for receiving said tube support members being formed by said respective radial beam elements in order to provide a staggered configuration for said tube support members.

9. The support assembly of claim 1 wherein said tube support members are rings arranged in concentrically spaced apart relation, said bars being arranged in radially extending relation to form said tube openings and said flow passages.

* * * * *

UNITED STATES PATENT AND TRADEMARK OFFICE

CERTIFICATE OF CORRECTION

PATENT NO. : 4,154,295

DATED : May 15, 1979

INVENTOR(S) : John A. Kissinger

It is certified that error appears in the above–identified patent and that said Letters Patent are hereby corrected as shown below:

Column 3, Line 68, "54" should read --54'--.

Column 4, Line 9, "(62 in FIG. 1)" should read --(60 in FIG. 1)--.

Signed and Sealed this

*Twentieth* Day of *November 1979*

[SEAL]

*Attest:*

RUTH C. MASON
*Attesting Officer*

LUTRELLE F. PARKER
*Acting Commissioner of Patents and Trademarks*